US010533710B2

(12) United States Patent
Tubbert, III et al.

(10) Patent No.: US 10,533,710 B2
(45) Date of Patent: Jan. 14, 2020

(54) TERMINAL TRACTOR WITH VERSATILE FUELING

(71) Applicant: Terminal Investment Corporation, Savannah, GA (US)

(72) Inventors: Francis H. Tubbert, III, Pooler, GA (US); Harold E. King, Beaufort, SC (US)

( * ) Notice: Subject to any disclaimer, the term of this patent is extended or adjusted under 35 U.S.C. 154(b) by 113 days.

(21) Appl. No.: 15/803,312

(22) Filed: Nov. 3, 2017

(65) Prior Publication Data

US 2019/0137043 A1 May 9, 2019

(51) Int. Cl.
*F17C 13/08* (2006.01)

(52) U.S. Cl.
CPC ..... *F17C 13/084* (2013.01); *F17C 13/083* (2013.01); *F17C 2201/0104* (2013.01); *F17C 2201/037* (2013.01); *F17C 2201/058* (2013.01); *F17C 2203/0609* (2013.01); *F17C 2205/013* (2013.01); *F17C 2205/0107* (2013.01); *F17C 2205/0142* (2013.01); *F17C 2221/035* (2013.01); *F17C 2223/0153* (2013.01); *F17C 2223/033* (2013.01); *F17C 2250/0426* (2013.01); *F17C 2250/0491* (2013.01); *F17C 2250/0689* (2013.01); *F17C 2265/066* (2013.01); *F17C 2270/0168* (2013.01); *F17C 2270/0171* (2013.01)

(58) Field of Classification Search
None
See application file for complete search history.

(56) References Cited

U.S. PATENT DOCUMENTS

| | | | | |
|---|---|---|---|---|
| 7,047,947 | B2 * | 5/2006 | Van Dyke | B60K 15/03006 123/509 |
| 9,567,203 | B2 * | 2/2017 | Komuniecki | B60K 15/07 |
| 9,592,731 | B2 * | 3/2017 | Hanlin | F02M 21/0215 |
| 2018/0031180 | A1 * | 2/2018 | Kim | B67D 7/3272 |

OTHER PUBLICATIONS

Tarantin Industries full-line catalog, p. 73 (Year: 2015).*

* cited by examiner

*Primary Examiner* — Joseph M Rocca
*Assistant Examiner* — Harold Eric Pahlck, III
(74) *Attorney, Agent, or Firm* — John G. Posa; Belzer PC

(57) ABSTRACT

A vehicle such as a terminal or yard tractor used for freight spotting is provided with one or more individual, portable LPG cylinders of the type used by forklifts facilitating tank swapping on an as-needed basis for reduced downtime. Each auxiliary cylinder is a portable, removable and replaceable cylinder having a fuel capacity less than that of the vehicle's primary tank. A controller interfaced to a sensor and a pump is operative to pump fuel from the auxiliary LPG cylinder and into the fuel line to refill the primary LPG tank when the fuel level of the primary tank falls below a predetermined level. The invention may be factory-installed onto the vehicle, or may be provided as a kit enabling an existing vehicle to be retrofitted with the auxiliary LPG cylinder(s).

6 Claims, 5 Drawing Sheets

TERMINAL TRACTOR WITH VERSATILE FUELING

FIELD OF THE INVENTION

This invention relates generally to tractor-trailers and, in particular, to a tractor with versatile fueling options.

BACKGROUND OF THE INVENTION

Cross-docking is a practice in the logistics industry wherein materials are unloaded from an incoming semi-trailer truck or railroad car, and loaded directly onto outbound trucks, trailers, or rail cars, with little or no storage in between. This may be done to change the type of material carrier, to sort material for different destinations, or to combine material from different origins into transport vehicles (or containers) with the same or similar destinations.

Cross-docking is done with various vehicles, including forklifts and yard or terminal tractors. One such tractor, shown in FIG. 1, is the Pro-Spotter built by TICO Manufacturing of Ridgeland, S.C., which is used at distribution centers, rail terminals and ports. These tractors are smaller than full-sized "semis," and are designed to transport relatively small freight, sometimes referred to as less-than-truckload or LTL shipping, with freight that occupies only a portion of an entire trailer. Multiple shippers can share space on the same truck, only paying for their portion, making LTL a cost efficient method of shipping freight.

In the LTL trucking industry, cross-docking is done by moving cargo from one transport vehicle directly onto another, with minimal or no warehousing. In retail practice, cross-docking operations may utilize staging areas where inbound materials are sorted, consolidated, and stored until the outbound shipment is complete and ready to ship. Terminal tractors that are then used to "spot" trailers to and from the doors of the terminal.

While some cross-docking tractors are diesel-powered, TICO recently introduced a Pro-Spotter that runs on LPG (as used herein, Liquefied Petroleum Gas; Liquefied Propane Gas; or simply "propane"). As an alternative to conventional diesel fueled terminal tractors, LPG is a cleaner fuel that eliminates the need for bulk diesel storage on site with associated environmental issues. Diesel-powered terminal tractors must also be DOT certified to travel on public streets to go to a fueling facility with attendant diesel emissions maintenance complications.

Many facilities, including LTL cross-dock terminals, currently use large numbers of forklifts powered by individual, portable LPG cylinders. Such cylinders enable efficient refueling (i.e., by swapping). Like many industries, high throughput is essential the cross-docking industry. While LPG-powered terminal tractors come equipped with a single, primary LPG fuel tank, down-time may be incurred when this larger tank requires refilling.

SUMMARY OF THE INVENTION

This invention improves upon existing freight-hauling tractors by providing a tractor with one or more individual, portable LPG cylinders of the same type used by forklifts. The result is a system that exploits a common fuel technology with tank swapping on an as-needed basis with enhanced throughput.

The system is configured for use with a tractor having a chassis including front and rear wheels, an operator cab and an engine that consumes LPG from a primary fuel tank. At least one auxiliary LPG cylinder is mounted on the chassis, the auxiliary cylinder being a portable, removable and replaceable cylinder having a fuel capacity less than that of the primary tank. A controller interfaced to a sensor and a pump is operative to pump fuel from the auxiliary LPG cylinder and into the fuel line to refill the primary LPG tank when the fuel level of the primary tank falls below a predetermined level.

The preferred embodiment includes two auxiliary LPG cylinders that may be removed and replaced, and an indicator informing an operator that the auxiliary LPG cylinders are in need of replacement. The tractor may be a terminal tractor of the type used for cross-docking operations. The invention may be factory-installed onto the vehicle, or may be provided as a kit enabling an existing vehicle to be retrofitted with the auxiliary LPG cylinder(s).

DETAILED DESCRIPTION OF THE PREFERRED EMBODIMENTS

Figure 1:
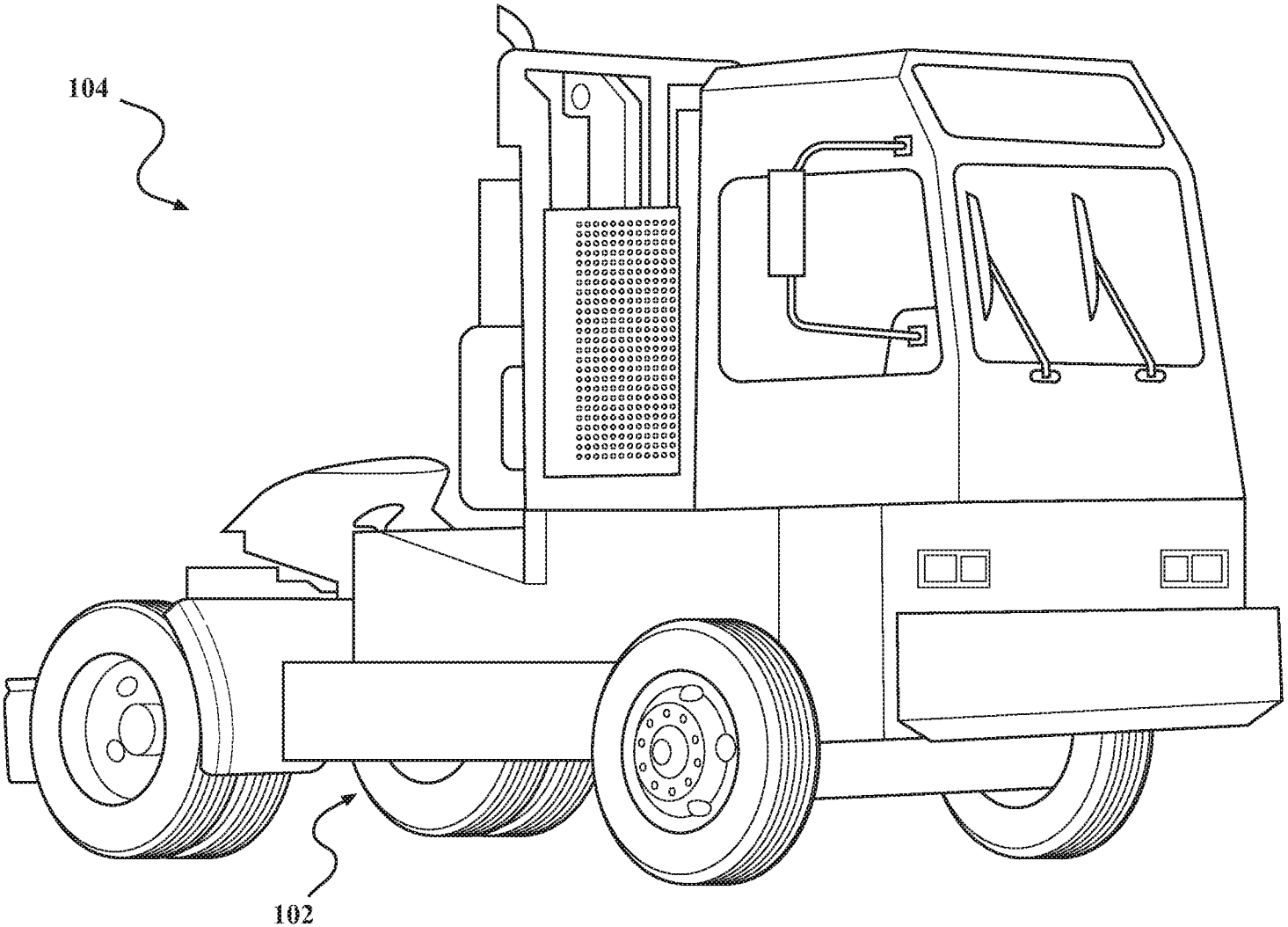
FIG. 1 is a perspective view of an existing terminal tractor.

Referring back to FIG. 1, the prior-art terminal tractor depicted therein includes two frames 102, 104, one on each side of the vehicle between the right and left front and rear wheels, respectively. On the current TICO LPG-powered tractor, the driver side frame is used for a primary LPG tank, while the passenger side frame is used for storage purposes. In accordance with this invention, both frames are used for LPG tanks, one with the main tank and the other with at least one smaller, portable LPG cylinder.

Figure 2:
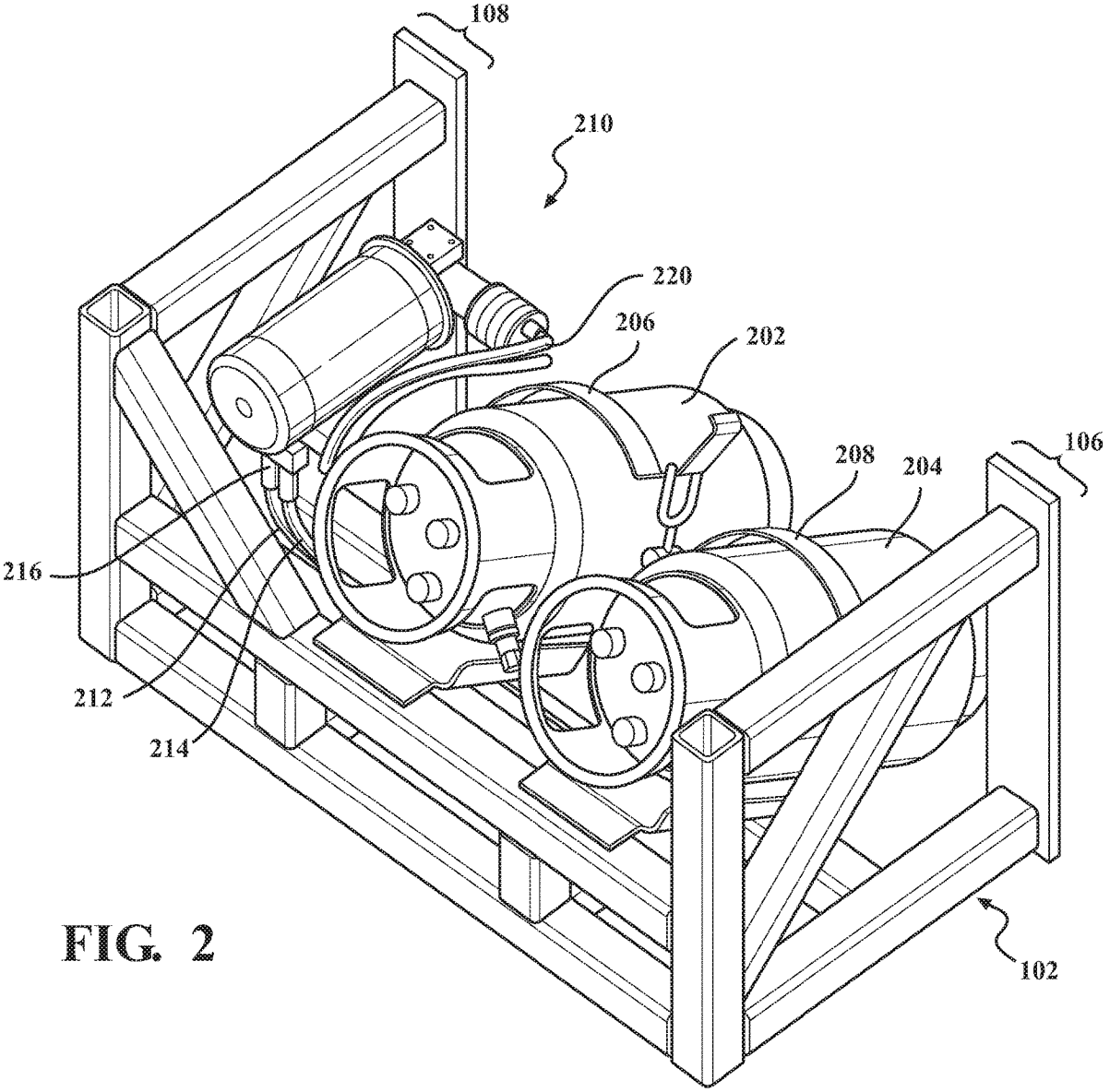
FIG. 2 is a perspective view of a preferred embodiment of the invention showing two portable LPG cylinders.
Figure 3:
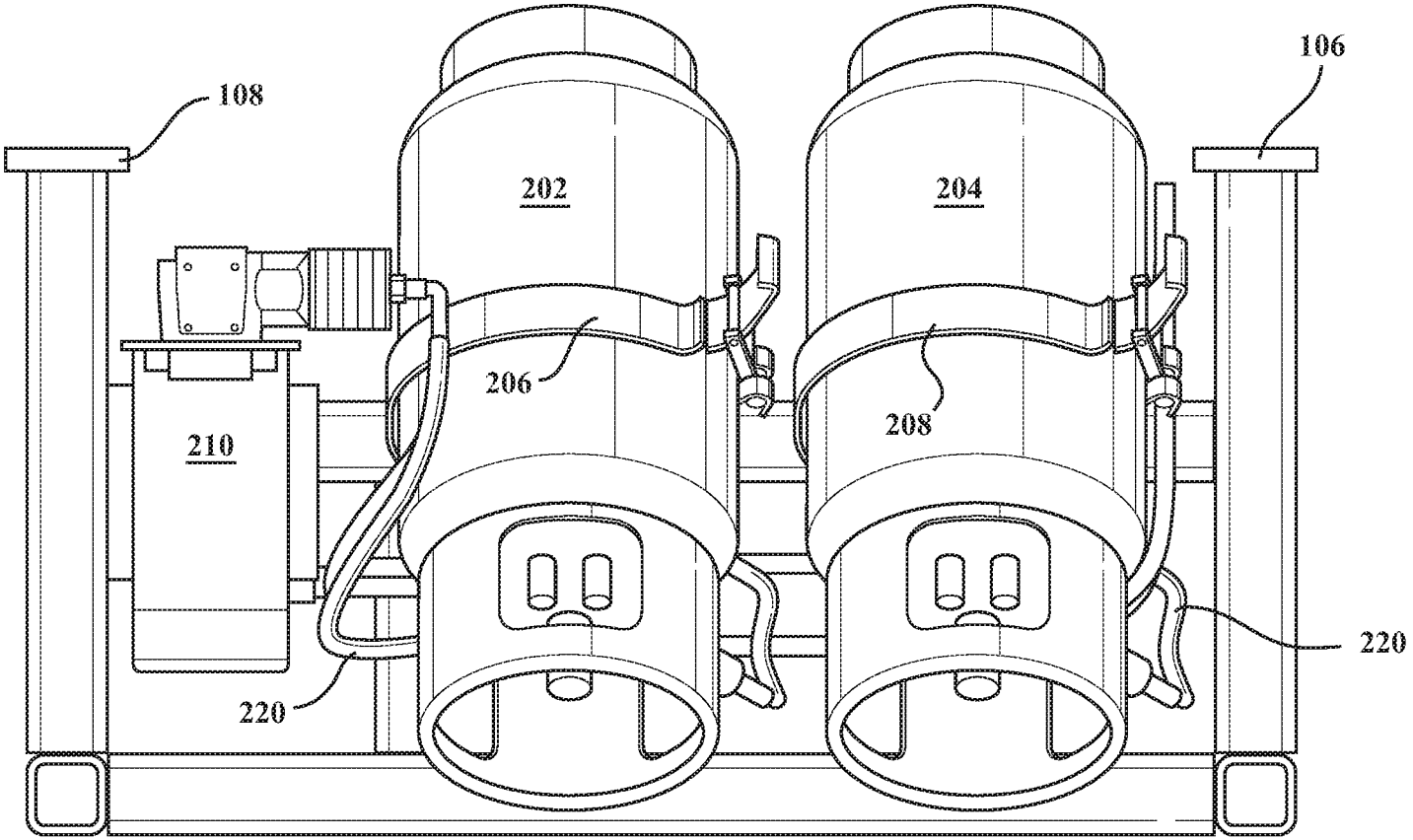
FIG. 3 is a top-down view of the embodiment of FIG. 2.
Figure 4:
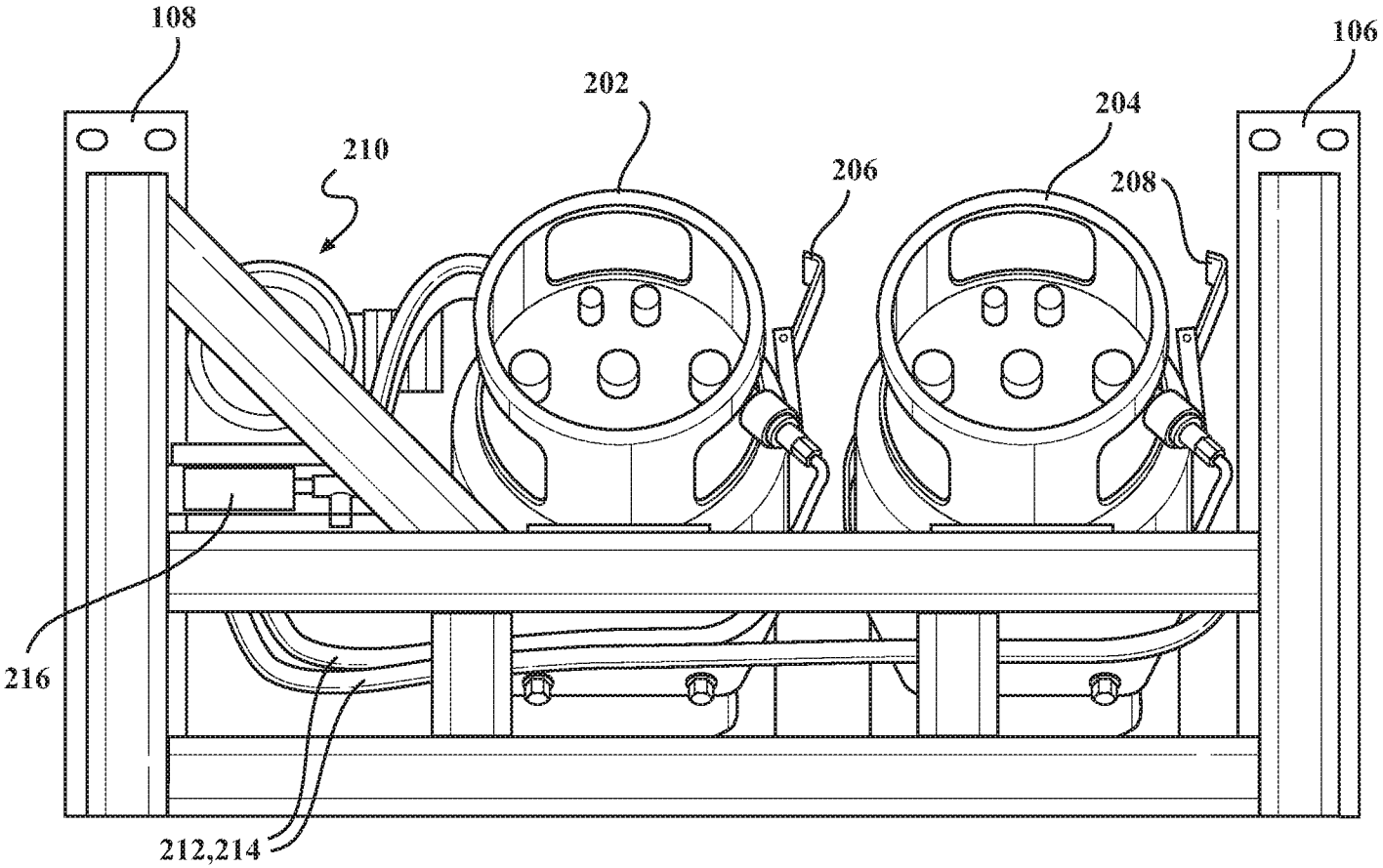
FIG. 4 is a side-facing view of the embodiment of FIGS. 2, 3.

Frame 102 holding the portable tank(s) is shown in FIGS. 2-4. The frame is bolted onto the side of the vehicle through plates 106, 108. In the preferred embodiment, two 33.5 lb. (7.7 gal.) tanks are used. However the invention is not limited in this regard, as more or fewer, different capacity portable tanks may alternatively be used, including 20 lb. (4.6 gal.) and 43.5 lb. (9.9 gal.) cylinders.

The cylinders 202, 204 are held in position with the usual straps 206, 208. The output lines 212, 214 of the tanks are routed to a common manifold 216. As with forklifts, each cylinder is replaced by undoing the strap and disconnecting the connector on the side of the tank. The LPG from the manifold is fed to a pump 210, which distribute the LPG via lines 220 to the vehicle.

Figure 5:
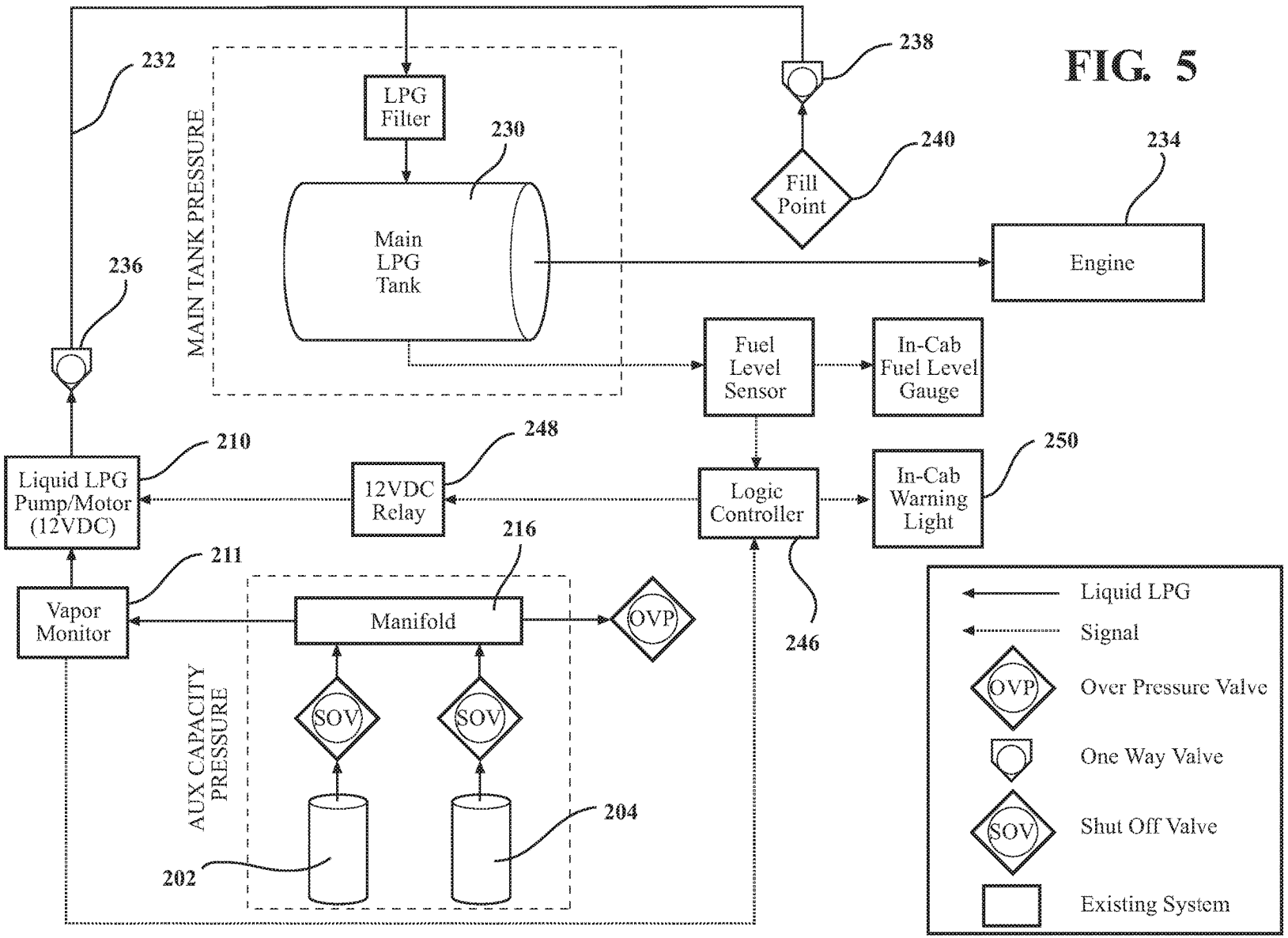
FIG. 5 is a block diagram illustrating important components of the preferred embodiment.

FIG. 5 is a block diagram of the various components. The system may be factory built or configured as a retrofit to an existing LPG-powered vehicle. With respect to the latter, the shaded blocks indicate the existing system of the LPG-powered vehicle, whereas the non-shaded blocks are the components that would be added as part of a retrofit. In any case, solid lines represent liquid LPG lines, while dashed lines represent electrical signals.

Continuing the reference to FIG. 5, LPG from pump 210 is fed to the main tank 230 through conduit 232. Only the main tank feeds the engine 234. As such, the auxiliary tanks

202, 204 act to supplement or "top-off" the fuel from the main tank. One-way valves 236, 238 act to ensure that only the main tank is filled through port 240.

Activation of the vehicle ignition system powers up AC/FERS Logic Controller (ALC) 246 and Pump Motor Relay (PMR) 248. The ALC determines the main tank fuel level through fuel level sensor 242. If the main tank fuel level is at or above a predetermined level, the ALC does nothing. If the main tank fuel level is below this level, the ALC energizes the PMR, and Liquid Propane Gas (LPG) begins to flow from the auxiliary cylinders.

The predetermined level for PMR activation may be any appropriate level in view of trade-offs associated with sizes of the various tanks and the desired frequency of cylinder change-out. For example, the predetermined level may be in the range of 50-90%. More preferably, the level may be in the range of 70-90%. Most preferably, for the system disclosed herein, it was discovered that if the primary fuel tank is ⅞ full (of 80% useable volume), the ALC does nothing. If the main tank fuel level is below ⅞ Full (of 80% useable volume), the ALC energizes the PMR, and LPG begins to flow from cylinders 202, 204 through Minimum Level Detector (MLD) 211. If the MLD detects no vapor in the LPG stream, the ALC continues to energize the PMR until main fuel tank level is at full (of 80% useable volume), then de-energizes the PMR.

If the MLD detects vapor in LPG stream, the ALC de-energizes the PMR, and powers Cab Warning Lamp (CWL) 250. If the CWL is activated, the vehicle ignition must be powered off for at least 5 minutes (to change the LPG cylinders) before the ALC goes back to the step of determining the main tank fuel level through fuel level sensor 242.

While the system described herein is intended for use with yard or terminal tractors or trucks used for trailer spotting, the invention is more widely applicable to any vehicle that would benefit from auxiliary LPG tanks. Further, while the preferred embodiment shows a primary fuel tank and at least one auxiliary LPG cylinder, a system is possible using only a plurality of portable LPG cylinders, on both sides of the vehicle, for example, with appropriate logic control and valves for fuel distribution. Further, while LPG may be mixed with other fuels including diesel with appropriate engine modification, a mixed-fuel embodiment of the invention is also possible with one or more portable LPG cylinders and a primary tank containing a different type of fuel.

The invention claimed is:

1. A tractor configured to pull a trailer, comprising:

a chassis including front and rear wheels, an operator cab and an engine that consumes LPG;

a primary LPG tank having a fuel capacity;

a primary fuel line connecting the primary fuel tank to the engine;

at least one auxiliary LPG cylinder mounted on the chassis, the auxiliary cylinder being a portable, removable and replaceable cylinder having a fuel capacity less than that of the primary tank;

a sensor for determining the level of fuel in the primary fuel tank;

a secondary fuel line connecting the at least one auxiliary LPG cylinder to the primary LPG tank;

a pump disposed in the secondary fuel line for pumping fuel from the auxiliary LPG cylinder into the primary LPG tank; and a controller interfaced to the sensor and pump, the controller being operative to pump fuel from the at least one auxiliary LPG cylinder and into the secondary fuel line to refill the primary LPG tank when the fuel level of the primary tank falls below a predetermined level.

2. The tractor of claim 1, including two auxiliary LPG cylinders, both connected to a manifold in fluid communication with the fuel line connecting the primary fuel tank to the engine.

3. The tractor of claim 2, wherein the cylinders are standard 33.5 lb. cylinders.

4. The tractor of claim 1, further including an indicator for informing an operator that the auxiliary LPG cylinder is in need of replacement.

5. The tractor of claim 1, wherein the auxiliary LPG is disposed in a side rack mounted on the chassis between the front and rear wheels.

6. The tractor of claim 1, wherein the tractor is a terminal tractor configured for cross-docking operations.

* * * * *